US005243795A

United States Patent [19]

Roberts

[11] Patent Number: 5,243,795

[45] Date of Patent: Sep. 14, 1993

[54] TIE DOWN STAKE

[76] Inventor: Bruce Roberts, 2600 Borregas Dr., Aptos, Calif. 95003

[21] Appl. No.: 734,604

[22] Filed: Sep. 20, 1991

[51] Int. Cl.[5] ..... E02D 5/74

[52] U.S. Cl. ..... 52/158; 52/166; 405/244

[58] Field of Search ..... 52/158, 160, 166, 724, 52/725; 405/244, 259, 229, 233; 248/499, 507, 508; 135/118

[56] References Cited

U.S. PATENT DOCUMENTS

| | | | |
|---|---|---|---|
| 1,808,633 | 6/1931 | Carver | 52/158 |
| 2,870,884 | 1/1959 | Mazur | 52/158 |
| 3,110,368 | 11/1963 | Ross | 52/158 |
| 3,431,924 | 3/1969 | Simpson | 135/15 |
| 3,534,751 | 10/1970 | Peters | 135/15 |
| 3,788,335 | 1/1974 | Hemmelsbach | 135/1 R |
| 3,937,436 | 2/1976 | Stewart | 248/499 |
| 4,063,567 | 12/1977 | Martin et al. | 135/15 |
| 4,144,843 | 3/1979 | Schrougham . | |
| 4,308,683 | 1/1982 | Lee . | |
| 4,315,387 | 2/1982 | Lee | 52/156 |
| 4,491,091 | 1/1985 | Satterfield . | |
| 4,543,972 | 10/1985 | Bennet et al. | 135/118 |
| 4,679,369 | 7/1987 | Kinsley et al. . | |
| 4,800,843 | 1/1989 | Wendling | 119/117 |
| 4,831,798 | 5/1989 | Otteson . | |
| 4,936,194 | 6/1990 | Horowitz . | |
| 5,039,256 | 8/1991 | Gagliano | 405/244 |

*Primary Examiner*—Carl D. Friedman
*Assistant Examiner*—Kien Nguyen
*Attorney, Agent, or Firm*—James J. Leary

[57] ABSTRACT

A tie down stake for anchoring small aircraft or other objects to the ground in any soil conditions and which consists of a central hub with an eyelet and a plurality of holes that serve as stake guides for directing a plurality of anchoring rods at a fixed angle downward and outward into the ground. Thus joined by the hub, the anchoring rods cooperate together to form a secure earth anchor. Also disclosed are a rod removal tool, a security cap and a packing tube for use with the tie down stake.

11 Claims, 4 Drawing Sheets

TIE DOWN STAKE

The present invention relates to a tie down stake, more particularly, to a tie down stake that serves as a secure earth anchor for tying down small aircraft.

Although this tie down stake was designed particularly for securing small aircraft to the ground, the inventor envisions many other uses for it wherever a secure ground anchor is needed. Some of the uses envisioned are as a tent stake, as a tether stake for pets or livestock, as an anchor for temporary structures or mobile homes, as a land anchor for boats and land vehicles or as a winching anchor for off road vehicles equipped with winches.

BACKGROUND OF THE INVENTION

Small aircraft, when they are not in use and stored on the ground, should be securely tied down to prevent their being moved or damaged in a high wind. Sometimes commercial airports provide permanent tie downs which are secured to the ground. More frequently, though, an aircraft owner must provide his own tie down device. This is especially true when landing an aircraft at a remote landing field far from an airport.

The most common type of portable tie down anchor used by most small craft pilots is an auger-type stake that screws into the ground. These devices suffer from a number of drawbacks, most notably that they are difficult to deploy and they do not always hold securely. Auger-type stakes are frequently difficult to screw into the ground and are nearly impossible to use in hard or rocky soil. Furthermore, in soft, sandy or muddy soil auger-type stakes do not always provide a secure hold since they only engage an area of the ground as large as the diameter of the auger itself. Another disadvantage to auger-type tie down stakes is that they tend to pick up large amounts of dirt when they are removed from the ground, and their complicated geometry makes them difficult to clean.

SUMMARY OF THE INVENTION

The object of the present invention is to overcome the drawbacks of the tie down devices in current usage. The primary objective is to provide a tie down stake which is easy to deploy while providing a secure hold in any kind of soil conditions. Other objectives of the invention are to provide a tie down stake which is easy to remove, lightweight, portable and easy to clean. Additionally, one objective is to provide a tie down stake that can be locked with a conventional padlock for added security when used to tie down valuable property such as an airplane, boat or other vehicle. To accomplish these objectives the tie down stake of the present invention uses a central hub with holes that act as stake guides to direct a plurality of anchoring rods at a fixed angle downward and outward. Thus joined by the hub, the rods work cooperatively to engage a large area of the ground forming an earth anchor with exceptional pullout resistance even in soft, sandy or muddy soil. At the same time the tie down stake is easy to use because the straight rods are easily driven into the ground even in hard or rocky soil.

DESCRIPTION OF THE PREFERRED EMBODIMENT

The major components of the tie down stake include a central hub 1 and a plurality of anchoring rods 4. In the preferred embodiment, the tie down stake includes three rods 4, though it will easily be seen that two, three, four or more rods may be used to advantage without departing from the spirit of the invention.

The hub 1 should be made of a strong lightweight material. Acceptable materials for the hub include polymers such as acetal, nylon or polycarbonate or metals such as aluminum. In the preferred embodiment the hub is generally cylindrical in shape, but it may be made in any shape convenient to the use and manufacture of the tie down stake.

Figure 1:
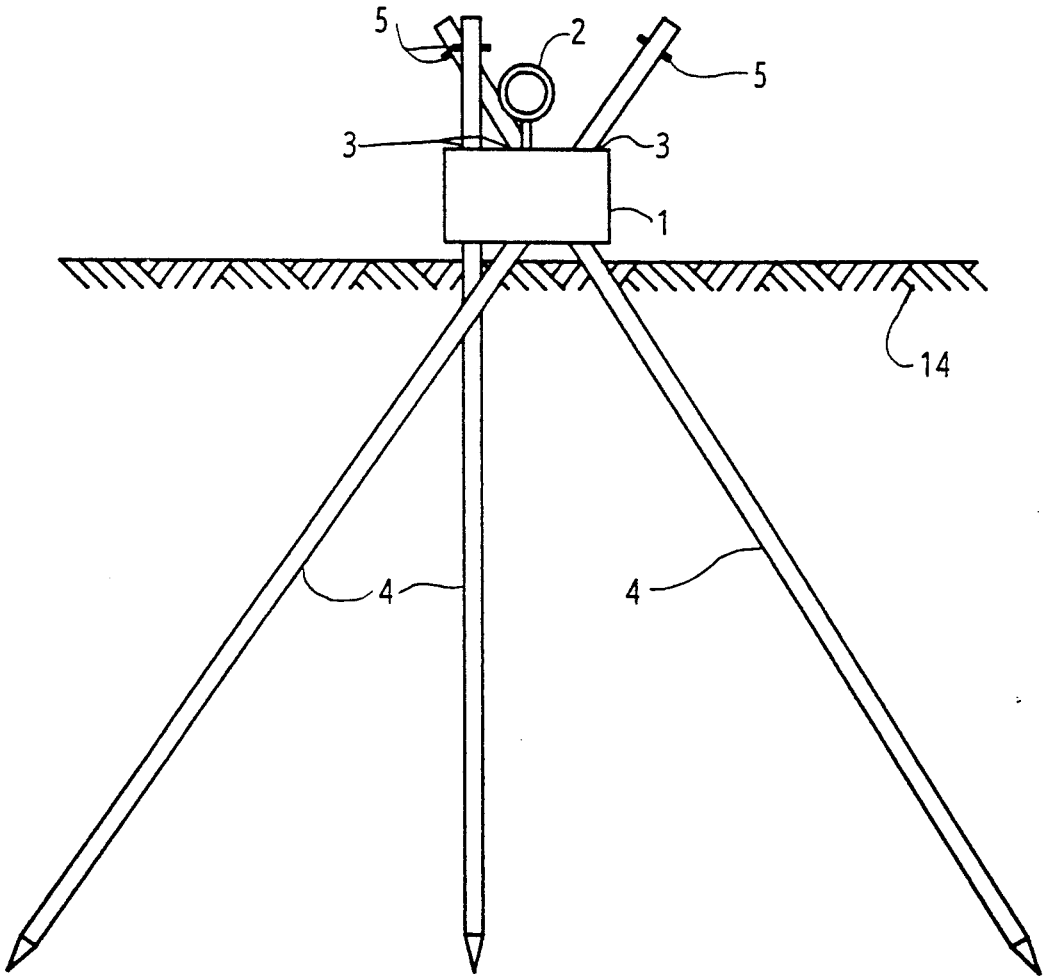
FIG. 1 shows a front view of the tie down stake in the deployed position.

The hub 1 has an eyelet 2 extending from the body of the hub 1 for attachment of a rope, cable, chain or other attachment device. The eyelet may be made from an eyebolt as illustrated in FIG. 1 or it may be formed integrally with the body of the hub 1, extending from the top or side of the hub 1.

Figure 2:
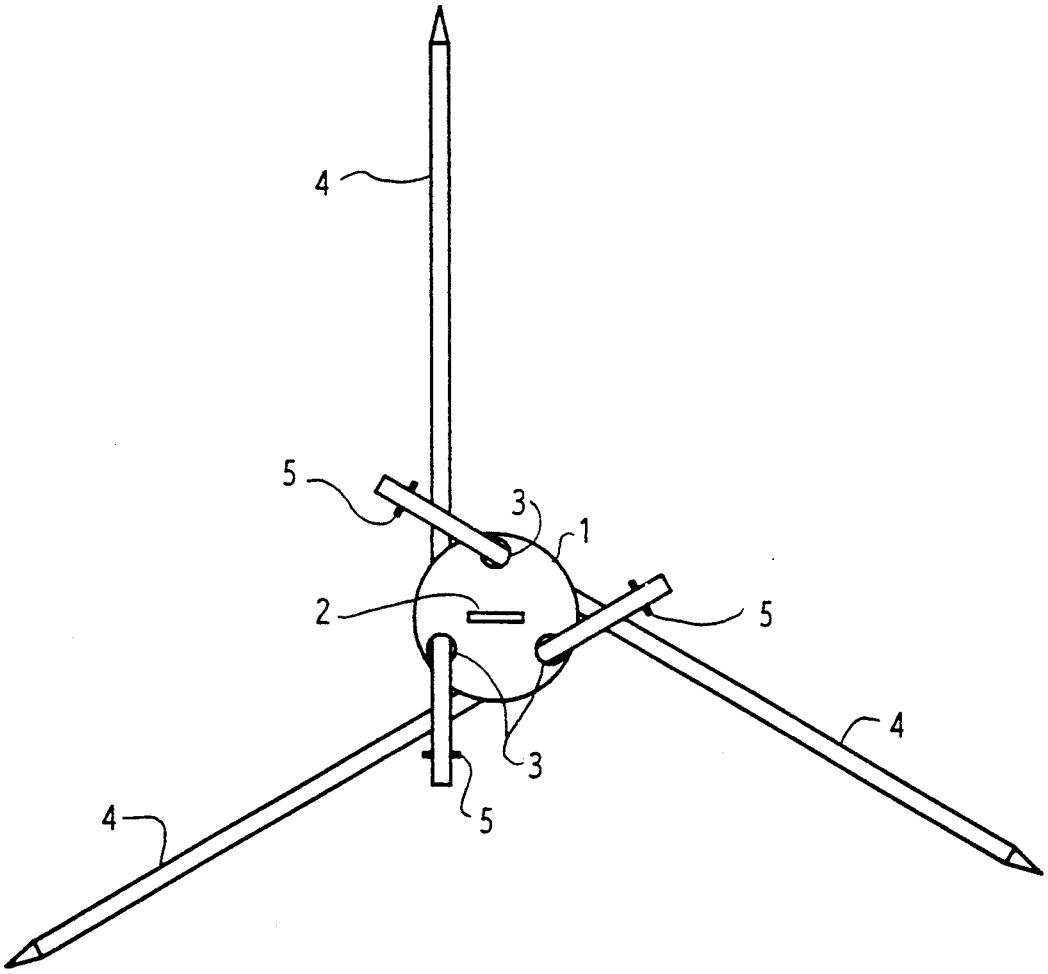
FIG. 2 shows a top view of the tie down stake in the deployed position.
Figure 3:
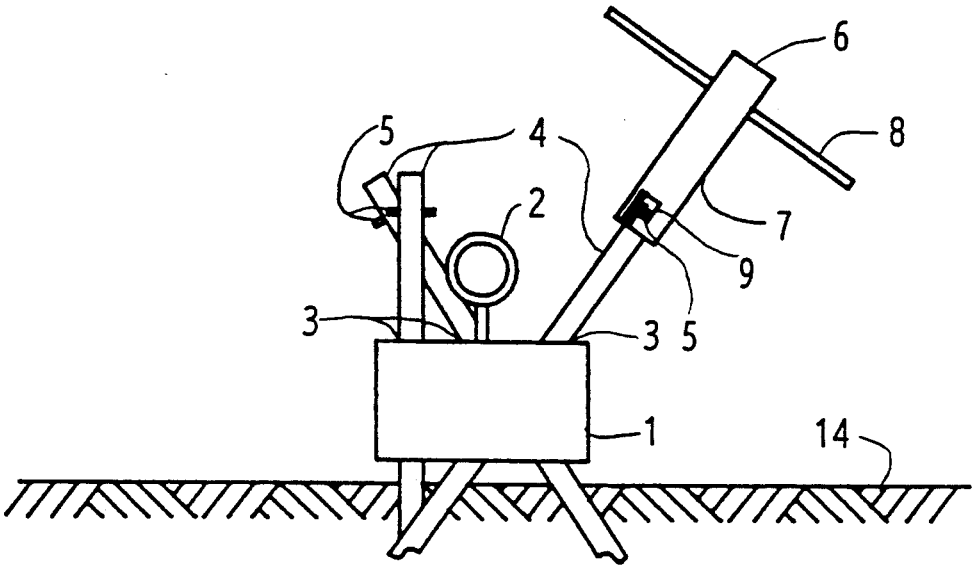
FIG. 3 illustrates the rod removal tool being used to remove the tie down stake from the ground.

The hub also contains a plurality of holes 3 equal in number to the number of rods 4 and slightly larger in diameter than the rods 4 themselves. The holes 3 in the hub 1 are formed at an angle to direct the rods 4 downward and outward in use. The tie down stake has been found to be most effective when the holes 3 are formed along a line that is skew to the vertical axis of the hub 1 so that the rods approximate a downward spiral as is apparent from the top view in FIG. 2. The advantage of this arrangement is that the rods 4 do not interfere with the eyelet 2 or with one another when they are inserted our withdrawn.

The rods 4 are elongate in shape and are sharpened at one end for penetrating the ground and blunt at the other end for receiving the blows of a hammer or other object. The rods 4 may be made of steel, stainless steel or any other material strong enough to withstand being repeatedly driven into hard or rocky soil. The rods 4 may be circular in crossection or made in any other crossection that is convenient for their manufacture. Proximate the blunt end, the rods 4 include a head means 5 that allows the rods 4 to be gripped for withdrawal by the rod removal tool 6. The head means 5 may be a steel roll pin inserted into a hole through the rod 4 as shown in the illustrations or it may be any other geometry that allows it to be gripped for easy removal. Other possible geometries envisioned for the head means 5 include a flattened head like a nail, an L-shaped bend, a T shape, a hook or a loop. The rods 4 are of a sufficient length to provide secure holding force for the application intended. Eighteen inch rods have been found to provide adequate holding force for tying down small aircraft, though rods of a few inches to a few feet may be used in other applications.

Auxiliary components of the tie down stake include a rod removal tool 6, a security cap 10 and a packing tube 12:

The rod removal tool 6, in the preferred embodiment, comprises a hollow cylinder 7 with an inside diameter slightly larger than the rods 4 that has a handle bar 8 attached to it proximate one end. The other end of the cylinder 7 includes a pair of slots 9 that engage the head means 5 of the rods 4 much like a bayonette connector for easy withdrawal of the rods 4 from the ground 14.

Figure 4:
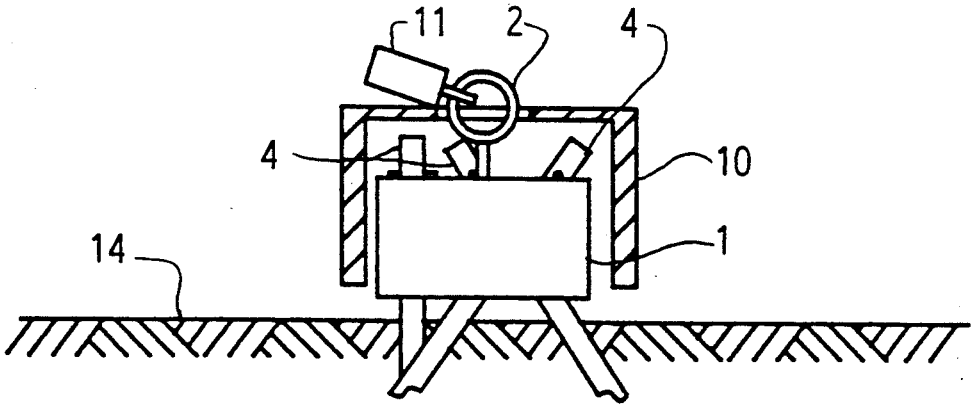
FIG. 4 is a sectional view of the tie down stake being used with the security cap and a padlock.

The security cap 10 is a hollow cylinder made of plastic or metal which is large enough to fit over the hub 1. It is closed at one end except for a slot which fits over the eyelet 2. The security cap can be locked over the hub 1 and the ends of the rods 4 with a padlock 11 as illustrated in FIG. 4.

Figure 5:
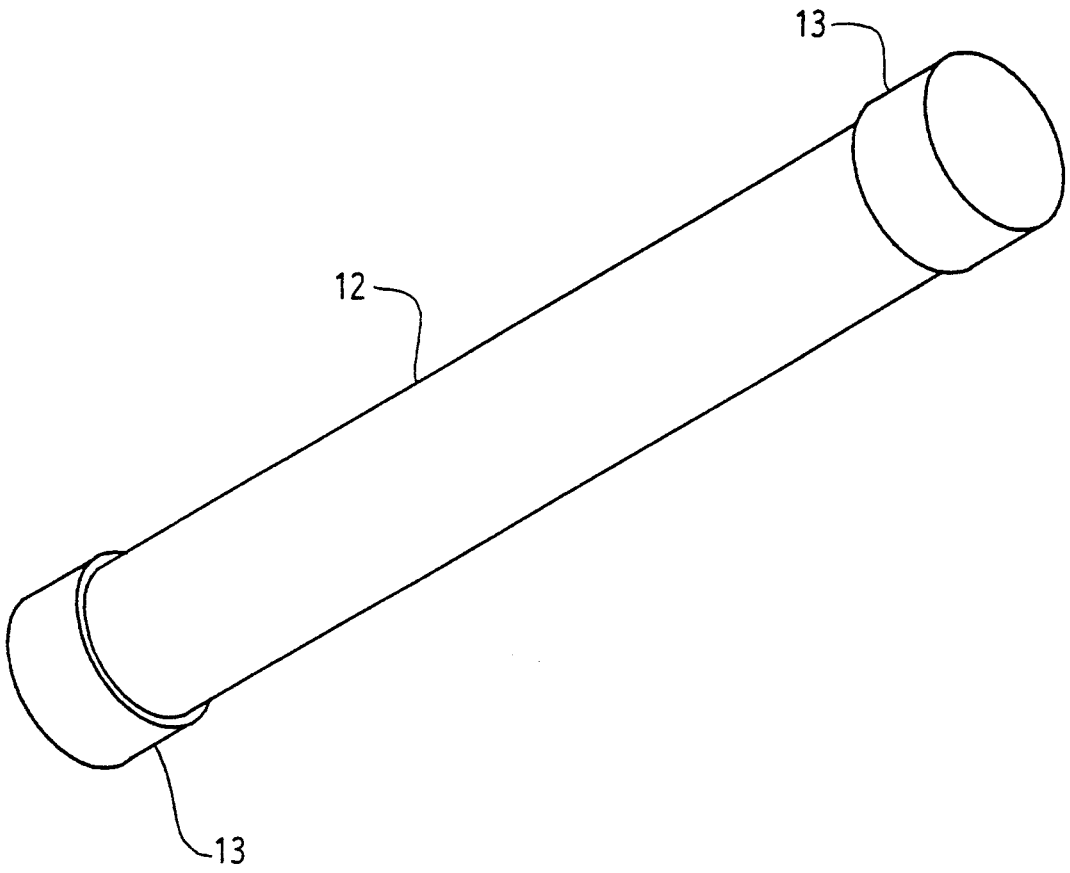
FIG. 5 shows the packing tube which can be used for storing the parts of the tie down stake.

The packing tube 12, illustrated in FIG. 5, is a hollow cylinder made of metal or plastic that is closed at both ends by end caps 13. The packing tube 12 is sized so that all of the other components of the tie down stake may be stored inside of it.

OPERATION OF THE TIE DOWN STAKE

INSERTION—The tie down stake is deployed by placing the hub on the ground in the desired location; then the rods are inserted through the holes in the hub and pushed into the ground or pounded in with a hammer or other object if required. The rods need not be driven all the way in to provide a secure hold. The rods are, in fact, easier to grip with the rod removal tool if a half inch or so of space is left between the head means and the hub. Once the tie down stake is secured to the ground, one end of a rope, cable, chain or other attachment device may attached to the eyelet.

If additional security is desired the rods can be pounded all of the way in and the security cap placed over the hub and rods. Then a padlock can be used to lock a chain or cable to the eyelet.

REMOVAL—To remove the tie down stake from the ground the rod removal tool is slipped over the end of the rods one at a time; the head means is engaged by the slots in the tool; then the rods are removed from the ground with a twisting and pulling action. The parts can easily be cleaned and stowed in the packing tube for later use.

While there is shown and described a present preferred embodiment of the invention, it is to be distinctly understood that the invention is not limited thereto, but may be otherwise variously embodied and practiced within the scope of the following claims.

I claim:

1. A tie down stake comprising:

a plurality of elongate anchoring rods, each of said rods having a first end and a second end, said first end being sharpened to penetrate the ground and said second end being blunt to receive the blows of a hammer, said second end having a head means by which to grip said rods, and a solid central hub, said hub having an upper surface and a ground-contacting lower surface, said hub having an eyelet attached thereto and said hub having a plurality of holes therethrough, said holes extending from said upper surface to said ground-contacting lower surface, said holes being slightly larger in diameter than said rods, and said holes being formed at an angle such that when said ground-contacting lower surface of said hub is placed on the ground and said rods are inserted through said holes, said rods are directed downward and outward into the ground thereby cooperating to form a secure, temporary earth anchor.

2. A tie down stake as in claim 1 wherein said solid central hub is made of a polymer.

3. A tie down stake as in claim 1 wherein said solid central hub is made of a metal.

4. A tie down stake as in claim 1 wherein said solid central hub contains three of said holes and wherein there are three of said anchoring rods.

5. A tie down stake as in claim 1 wherein said head means of said elongate anchoring rods comprises a pin inserted through a hole formed in said rods proximate said second end thereby forming a T-shaped head with which to grip said rods.

6. A tie down stake as in claim 1 wherein said rods are made of a material selected from the group consisting of steel and stainless stell alloy.

7. A tie down stake as in claim 1 further comprising a rod removal tool, said rod removal tool having a handle and a gripping means for gripping said head means of said rods and applying torsion and tensile force to said rods to aid in extracting said rods from the ground.

8. A tie down stake as in claim 1 further comprising a lockable security cap adapted to cover said hub, said security cap having a peripheral wall surrounding said hub and said second ends of said plurality of rods, said wall preventing said rods from being withdrawn from said hub, and said security cap having a locking means for locking said security cap to said hub such that said tie down stake can be securely locked in place to prevent unauthorized removal of said tie down stake.

9. A tie down stake as in claim 1 further comprising a packing tube of storage of the components of the tie down stake between uses.

10. A tie down stake comprising:

three elongate metal anchoring rods, each of said rods having a first end and a second end, said first end being sharpened to penetrate the ground and said second end being blunt to receive the blows of a hammer, said second end having a T-shaped head by which to grip said rods, and a solid central hub made of a polymer, said hub having an upper surface and a ground-contacting lower surface, said hub having an eyelet attached thereto and said hub having three holes therethrough, said holes extending from said upper surface to said ground-contacting lower surface, said holes being slightly larger in diameter than said rods, and said holes being formed at an angle such that when said ground-contacting lower surface of said hub is placed on the ground and said rods are inserted through said holes, said rods are directed downward and outward into the ground thereby cooperating to from a secure, temporary earth anchor.

11. The tie down stake of claim 10, wherein said solid central hub is of sufficient rigidity that when said lower surface of said hub is placed on the ground and said rods are inserted through said holes, said hub and said rods cooperate as an essentially rigid unit to resist dislodgement of the tie down stake from the ground when a force is exerted on said eyelet.

* * * * *